US007443989B2

(12) United States Patent
Choi et al.

(10) Patent No.: US 7,443,989 B2
(45) Date of Patent: Oct. 28, 2008

(54) ADAPTIVE BEAMFORMING METHOD AND APPARATUS USING FEEDBACK STRUCTURE

(75) Inventors: Changkyu Choi, Seoul (KR); Jaywoo Kim, Gyeonggi-do (KR); Donggeon Kong, Busan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 801 days.

(21) Appl. No.: 10/757,994

(22) Filed: Jan. 16, 2004

(65) Prior Publication Data

US 2004/0161121 A1 Aug. 19, 2004

(30) Foreign Application Priority Data

Jan. 17, 2003 (KR) ..... 10-2003-0003258

(51) Int. Cl.
*H04R 1/02* (2006.01)

(52) U.S. Cl. ..... 381/92; 381/94.1; 381/93; 702/190; 702/191

(58) Field of Classification Search ..... 381/91–93, 381/66, 71.12, 71.8, 71.1, 122, 94.1, 94.7, 381/94.2, 95, 71.11, 71.3, 71.5; 704/226; 702/190–196
See application file for complete search history.

(56) References Cited

U.S. PATENT DOCUMENTS 4,536,887 A * 8/1985 Kaneda et al. ..... 381/92
5,371,789 A * 12/1994 Hirano ..... 379/406.08
5,627,799 A * 5/1997 Hoshuyama ..... 367/121
6,002,776 A * 12/1999 Bhadkamkar et al. ..... 381/66
6,449,586 B1 * 9/2002 Hoshuyama ..... 702/190
6,885,750 B2 * 4/2005 Egelmeers et al. ..... 381/66
7,020,290 B1 * 3/2006 Ribic ..... 381/92

OTHER PUBLICATIONS

O. Hoshuyama, "A Robust Adaptive Beamformer for Microphone Arrays with a Blocking Matrix Using Constrained Adaptive Filters," *IEEE Transactions on Signal Processing*, vol. 47, No. 10, Oct. 1999, pp. 2677-2684.

G. Mirchandani, et al., "S New Adaptive Noise Cancellation Scheme in the Presence of Crosstalk," *IEEE Transactions on Circuits and Systems*, vol. 39, No. 10, Oct. 1999, pp. 681-694.

Benard Widrow, et al.; Adptive Noise Cancelling: Principles and Applications; *Proceedings of the IEEE*; vol. 63, No. 12; Dec. 1975.

(Continued)

*Primary Examiner*—Vivian Chin
*Assistant Examiner*—Disler Paul
(74) *Attorney, Agent, or Firm*—Staas & Halsey LLP

(57) ABSTRACT

An adaptive beamforming apparatus and method includes a fixed beamformer that compensates for time delays of M noise-containing speech signals input via a microphone array having M microphones (M is an integer greater than or equal to 2), and generates a sum signal of the M compensated noise-containing speech signals; and a multi-channel signal separator that extracts pure noise components from the M compensated noise-containing speech signals using M adaptive blocking filters that are connected to M adaptive canceling filters in a feedback structure and extracts pure speech components from the added signal using the M adaptive canceling filters that are connected to the M adaptive blocking filters in the feedback structure.

30 Claims, 5 Drawing Sheets

OTHER PUBLICATIONS

Nam soo Kim et al.; Spectral Enhancement Based on Global Soft Decision; *IEEE Signal Processing Letters*; vol. 7, No. 5, May 2000.

Anthony J. Bell et al.; An Information-Maximisation Approach to Blind Separation and Blind Deconvolution; *Computational Neurobiology Laboratory*; pp. 1004-1034; Feb. 1995.

Osamu Hoshuyama; A Robust Adaptive Beamformer for Microphone Arrays With a Blocking Matrix Using Constrained Adaptive Filters; *IEEE Transactions Signal Processing*; vol. 47, No. 10; Oct. 1999.

* cited by examiner

ADAPTIVE BEAMFORMING METHOD AND APPARATUS USING FEEDBACK STRUCTURE

CROSS-REFERENCE TO RELATED APPLICATIONS

This application claims the priority of Korean Patent Application No. 2003-3258, filed on Jan. 17, 2003, in the Korean Intellectual Property Office, the disclosure of which is incorporated herein in its entirety by reference.

BACKGROUND OF THE INVENTION

1. Field of the Invention

The present invention relates to an adaptive beamformer, and more particularly, to a method and apparatus for adaptive beamforming using a feedback structure.

2. Description of the Related Art

Mobile robots have applications in health-related fields, security, home networking, entertainment, and so forth, and are the focus of increasing interest. Interaction between people and mobile robots is necessary when operating the mobile robots. Like people, a mobile robot with a vision system has to recognize people and surroundings, find the position of a person talking in the vicinity of the mobile robot, and understand what the person is saying.

A voice input system of the mobile robot is indispensable for interaction between man and robot and is an important factor affecting autonomous mobility. Important factors affecting the voice input system of a mobile robot in an indoor environment are noise, reverberation, and distance. There are a variety of noise sources and reverberation due to walls or other objects in the indoor environment. Low frequency components of a voice are more attenuated than high frequency components with respect to distance. Accordingly, for proper interaction between a person and an autonomous mobile robot within a house, a voice input system has to enable the robot to recognize the person's voice at a distance of several meters.

Such a voice input system generally uses a microphone array comprising at least two microphones to improve voice detection and recognition. In order to remove noise components contained in a speech signal input via the microphone array, a single channel speech enhancement method, an adaptive acoustic noise canceling method, a blind signal separation method, and a generalized sidelobe canceling method are employed.

The single channel speech enhancement method, disclosed in "Spectral Enhancement Based on Global Soft Decision" (IEEE Signal Processing Letters, Vol. 7, No. 5, pp. 108-110, 2000) by Nam-Soo Kim and Joon-Hyuk Chang, uses one microphone and ensures high performance only when statistical characteristics of noise do not vary with time, like stationary background noise. The adaptive acoustic noise canceling method, disclosed in "Adaptive Noise Canceling: Principles and Applications" (Proceedings of IEEE, Vol. 63, No. 12, pp. 1692-1716, 1975) by B. Widrow et al., uses two microphones. Here, one of the two microphones is a reference microphone for receiving only noise. Thus, if only noise cannot be received or noise received by the reference microphone contains other noise components, the performance of the adaptive acoustic noise canceling method sharply drops. Also, the blind signal separation method is difficult to use in the actual environment and to implement real-time systems.

FIG. 1 is a block diagram of a conventional adaptive beamformer using the generalized sidelobe canceling method. The conventional adaptive beamformer includes a fixed beamformer (FBF) 11, an adaptive blocking matrix (ABM) 13, and an adaptive multi-input canceller (AMC) 15. The generalized sidelobe canceling method is described in more detail in "A Robust Adaptive Beamformer For Microphone Arrays With A Blocking Matrix Using Constrained Adaptive Filters" (IEEE Trans. Signal Processing, Vol. 47, No. 10, pp. 2677-2684, 1999) by O. Hoshuyama et al.

Referring to FIG. 1, the FBF 11 uses a delay-and-sum beamformer. In other words, the FBF 11 obtains the correlation of signals, $x_m(k)$, where m is an integer between 1 and M, input via microphones and calculates time delays among signals input via the microphones. Thereafter, the FBF 11 compensates for signals input via the microphones by the calculated time delays, and then adds the signals in order to output a signal b(k) having an improved signal-to-noise ratio (SNR). The ABM 13 subtracts the signal b(k) output from the FBF 11 through adaptive blocking filters (ABFs) from each of the signals whose time delays are compensated for in order to maximize noise components. The AMC 15 filters signals $z_m(k)$, where m is an integer between 1 and M, output from the ABM 13 through adaptive canceling filters (ACFs), and then adds the filtered signals, thereby generating noise components via M microphones. Thereafter, a signal output from the AMC 15 is subtracted from the signal b(k), which is delayed for a predetermined period of time D, to obtain a signal y(k) in which noise components are cancelled.

The operations of the ABM 13 and the AMC 15 shown in FIG. 1 will be described in more detail with reference to FIG. 2. The operations of the ABM 13 and the AMC 15 are the same as in the adaptive acoustic noise canceling method.

Referring to FIG. 2, the size of symbols S+N, S, and N denotes the relative magnitude of speech and noise signals in specific locations, and left symbols and right symbols separated by a slash '/' denote 'to-be' and 'as-is' states, respectively.

An ABF 21 adaptively filters the signal b(k) output from the FBF 11 according to the signal output from a first subtractor 23 so that a characteristic of speech components of the filtered signal output from the ABF 21 is the same as that of speech components of a microphone signal $x'_m(k)$ that is delayed for a predetermined period of time. The first subtractor 23 subtracts the signal output from the ABF 21 from the microphone signal $x'_m(k)$, where m is an integer between 1 and M, to obtain and output a signal $z_m(k)$ which is generated by canceling speech components S from the microphone signal $x'_m(k)$.

An ACF 25 adaptively filters the signal $z_m(k)$ output from the first subtractor 23 according to the signal output from a second subtractor 27 so that a characteristic of noise components of the filtered signal output from the ACF 25 is the same as that of noise components of the signal b(k). The second subtractor 27 subtracts the signal outputs from the ACF 25 from the signal b(k) and outputs a signal y(k) which is generated by canceling noise components N from the signal b(k).

However, the above-described generalized sidelobe canceling method has the following drawbacks. The delay-and-sum beamformer of the FBF 11 has to generate the signal b(k) with a very high SNR so that only pure noise signals are input to the AMC 15. However, because the delay-and-sum beamformer outputs a signal whose SNR is not very high, the overall performance drops. As a result, since the ABM 13 outputs a noise signal containing a speech signal, the AMC 15, using the output of the ABM 13, regards speech components contained in the signal output from the ABM 13 as noise and cancels the noise. Therefore, the adaptive beamformer finally outputs a speech signal containing noise components.

Also, because filters used in the generalized sidelobe canceling method have a feedforward connection structure, finite impulse response (FIR) filters are employed. When such FIR filters are used in the feedforward connection structure, 1000 or more filter taps are needed in a room reverberation environment. In addition, in a case where the ABF 21 and the ACF 25 are not properly trained, the performance of the adaptive beamformer may deteriorate. Thus, speech presence intervals and speech absence intervals are necessary for training the ABF 21 and the ACF 25. However, these training intervals are generally unavailable in practice. Moreover, because adaptation of the ABM 13 and the AMC 15 has to be alternately performed, a voice activity detector (VAD) is needed. In other words, for adaptation of the ABF 21, a speech component is a desired signal and a noise component is an undesired signal. On the contrary, for adaptation of the ACF 25, a noise component is a desired signal and a speech component is an undesired signal.

SUMMARY OF THE INVENTION

The present invention provides a method of adaptive beamforming using a feedback structure capable of almost completely canceling noise components contained in a wideband speech signal input from a microphone array comprising at least two microphones.

The present invention also provides an adaptive beamforming apparatus including a feedback structure to cancel noise components contained in wideband speech signals input from a microphone array.

Additional aspects and/or advantages of the invention will be set forth in part in the description which follows and, in part, will be obvious from the description, or may be learned by practice of the invention.

According to an aspect of the present invention, there is provided an adaptive beamforming method including compensating for time delays of M noise-containing speech signals input via a microphone array having M microphones (M is an integer greater than or equal to 2), and generating a sum signal of the M compensated noise-containing speech signals; and extracting pure noise components from the M compensated noise-containing speech signals using M adaptive blocking filters that are connected to M adaptive canceling filters in a feedback structure and extracting pure speech components from the sum signal using the M adaptive canceling filters that are connected to the M adaptive blocking filters in the feedback structure.

According to another aspect of the present invention, there is also provided an adaptive beamforming apparatus including: a fixed beamformer that compensates for time delays of M noise-containing speech signals input via a microphone array having M microphones (M is an integer greater than or equal to 2), and generates a sum signal of the M compensated noise-containing speech signals; and a multi-channel signal separator that extracts pure noise components from the M compensated noise-containing speech signals using M adaptive blocking filters that are connected to M adaptive canceling filters in a feedback structure and extracts pure speech components from the added signal using the M adaptive canceling filters that are connected to the M adaptive blocking filters in the feedback structure.

In an aspect of the present invention, the multi-channel signal separator includes a first filter that filters a noise-removed sum signal through the M adaptive blocking filters; a first subtractor that subtracts signals output from the M adaptive blocking filters from the M compensated noise-containing speech signals using M subtractors; a second filter that filters M subtraction results of the first subtractor through the M adaptive canceling filters; a second subtractor that subtracts signals output from the M adaptive canceling filters from the sum signal using M subtractors, and inputs M subtraction results to the M adaptive blocking filters as the noise-removed sum signal; and a second adder that adds signals output from the M subtractors of the second subtractor.

In an aspect of the present invention, the multi-channel signal separator includes a first filter that filters a noise-removed sum signal through the M adaptive blocking filters; a first subtractor that subtracts signals output from the M adaptive blocking filters from the M compensated noise-containing speech signals using M subtractors; a second filter that filters signals output from the M subtractors of the first subtractor through the M adaptive canceling filters; a second adder that adds signals output from M adaptive canceling filters of the second filter; and a second subtractor that subtracts signals output from the second adder from the signals output from the fixed beamformer and inputs M subtraction results to the M adaptive blocking filters as the noise-removed sum signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
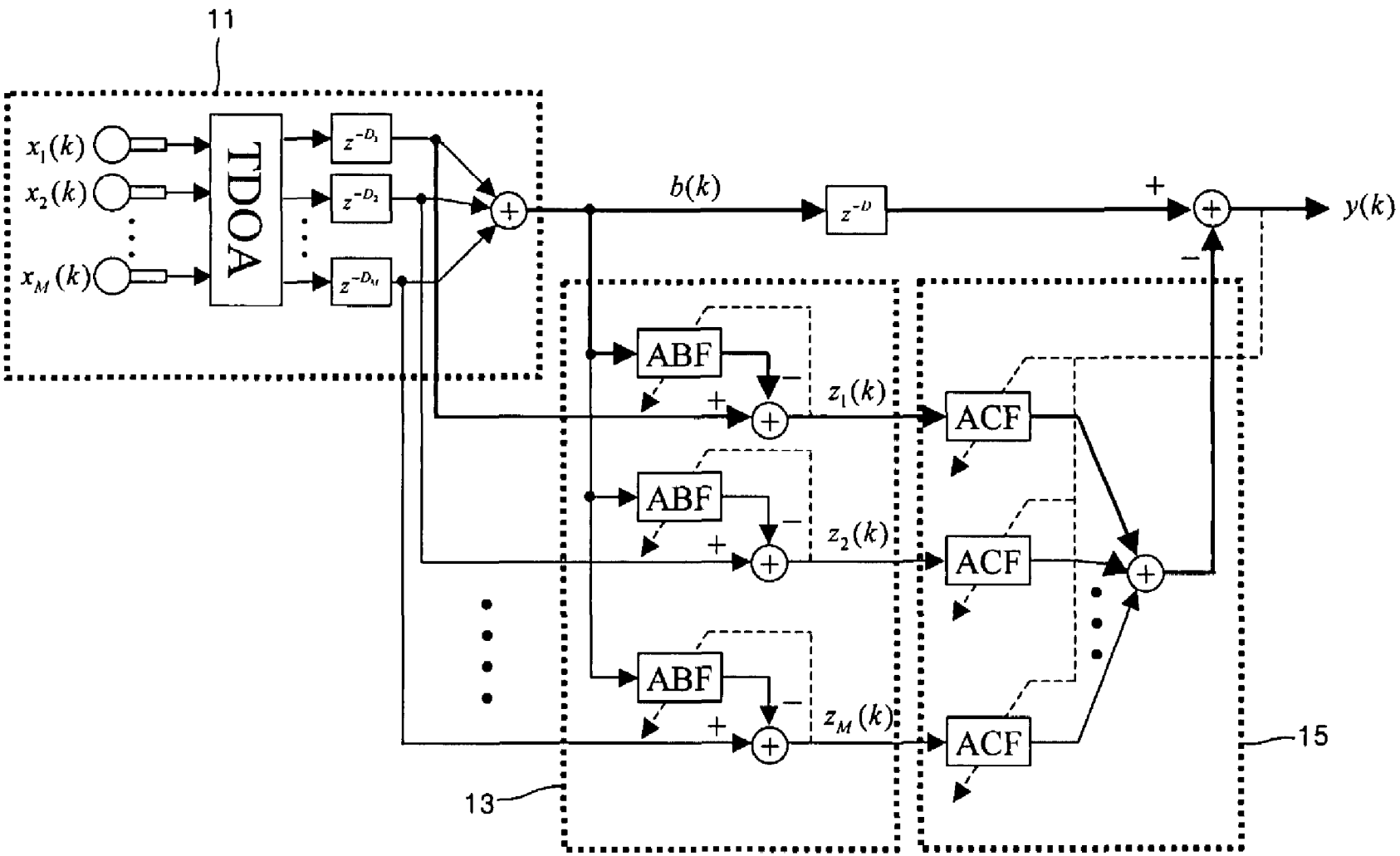
FIG. 1 (PRIOR ART)
FIG. 1 is a block diagram of a conventional adaptive beamformer.
Figure 2:
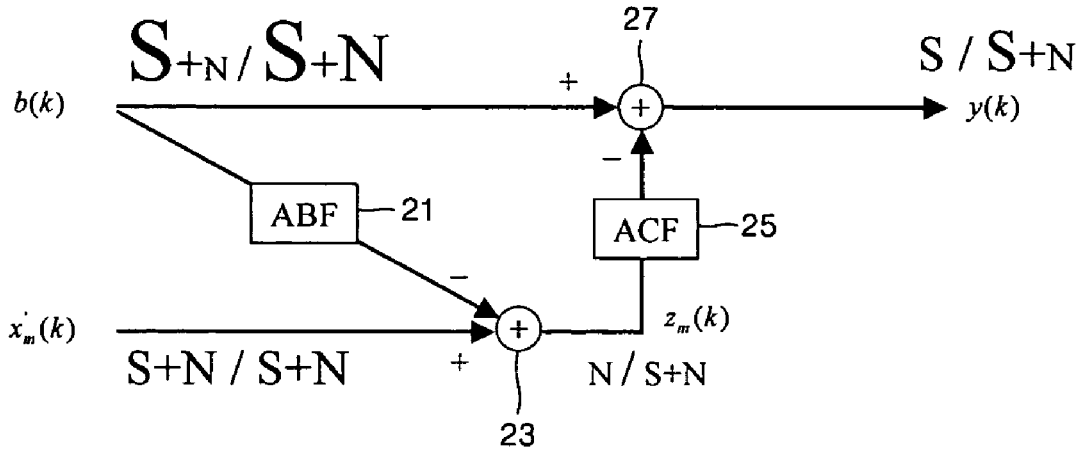
FIG. 2 (PRIOR ART)
FIG. 2 is a circuit diagram for explaining a feed-forward structure used in the conventional adaptive beamformer shown in FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, embodiments of the present invention will be described in detail with reference to the attached drawings. Meanwhile, "speech" used hereinafter is a representation implicitly including any target signal necessary for using the present invention.

Figure 3:
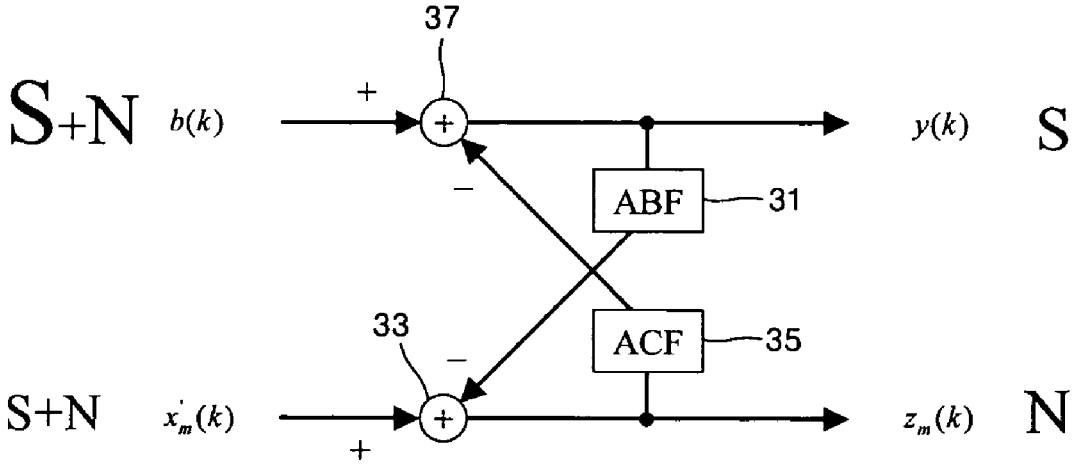
FIG. 3 is a circuit diagram explaining a feedback structure according to an embodiment of the present invention.

FIG. 3 is a circuit diagram for explaining a feedback structure according to an embodiment of the present invention. The feedback structure includes an adaptive blocking filter (ABF) 31, a first subtractor 33, an adaptive canceling filter (ACF) 35, and a second subtractor 37.

Referring to FIG. 3, the ABF 31 adaptively filters a signal y(k) output from the second subtractor 37 according to a signal output from the first subtractor 33 so that a characteristic of speech components of the filtered signal output from the ABF 31 is the same as that of speech components of a microphone signal $x'_m(k)$, where m is an integer between 1 and M, that is delayed for a predetermined period of time. A first subtractor 33 subtracts a signal output from the ABF 31 from a signal $x_m(k-D_m)$, i.e. $x'_m(k)$ obtained by delaying a signal $x_m(k)$ input to an $m^{th}$ microphone among M microphones, where M is an integer greater than or equal to 2, for a predetermined period of time $D_m$. As a result, the first subtractor 33 outputs only a pure noise signal N contained in the signal $x_m(k)$.

The ACF 35 adaptively filters a signal $z_m(k)$ output from the first subtractor 33 according to a signal output from the second subtractor 37 so that a characteristic of noise components of the filtered signal output from the ACF 35 is the same as that of noise components of the signal b(k) output from FBF 11 shown in FIG. 1. The second subtractor 37 subtracts the signal output from the ACF 35 from the signal b(k). Thus, the second subtractor 37 outputs only a pure speech signal S derived from the signal b(k) in which noise components are cancelled.

Figure 4:
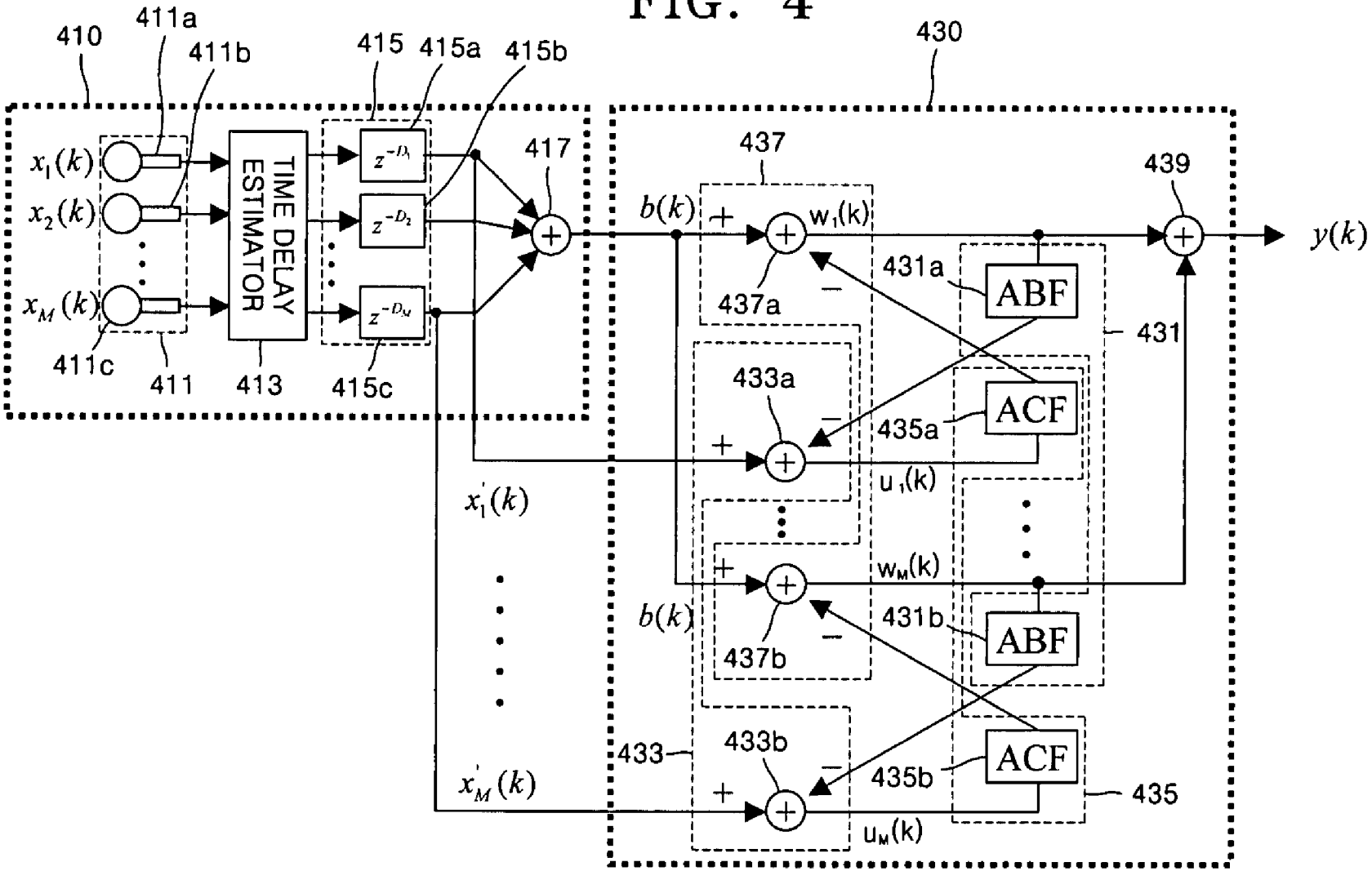
FIG. 4 is a block diagram of an adaptive beamformer according to an embodiment of the present invention.

FIG. 4 is a block diagram of an adaptive beamformer according to an embodiment of the present invention. The adaptive beamformer includes a fixed beamformer (FBF) 410 and a multi-channel signal separator 430. The FBF 410 includes a microphone array 411 having M microphones 411*a*, 411*b*, and 411*c*, a time delay estimator 413, a delayer 415 having M delay devices 415*a*, 415*b* and 415*c*, and a first adder 417. The multi-channel signal separator 430 includes a first filter 431 having M ABFs 431*a* and 431*b*, a first subtractor 433 having M subtractors 433*a* and 433*b*, a second filter 435 having M ACFs 435*a* and 435*b*, a second subtractor 437 having M subtractors 437*a* and 437*b*, and a second adder 439.

Referring to FIG. 4, in the FBF 410, the microphone array 411 receives speech signals $x_1(k)$, $x_2(k)$, and $x_M(k)$ via the M microphones 411*a*, 411*b* and 411*c*. The time delay estimator 413 obtains the correlation of the speech signals $x_1(k)$, $x_2(k)$ and $x_M(k)$ and calculates time delays $D_1$, $D_2$, and $D_M$ of the speech signals $x_1(k)$, $x_2(k)$ and $x_M(k)$. The M delay devices 415*a*, 415*b* and 415*c* of the delayer 415 respectively delay the speech signals $x_1(k)$, $x_2(k)$ and $x_M(k)$ by the time delays $D_1$, $D_2$ and $D_M$ calculated by the time delay estimator 413, and output speech signals $x_1'(k)$, $x_2'(k)$ and $x_M'(k)$. Here, the time delay estimator 413 may calculate time delays of speech signals using various methods besides the calculation of the correlation.

The first adder 417 adds the speech signals $x_1'(k)$, $x_2'(k)$ and $x_M'(k)$ and outputs a signal b(k). The signal b(k) output from the first adder 417 can be represented as in Equation 1.

$$b(k) = \sum_{m=1}^{M} x'_m(k),\ m = 1, \ldots, M \tag{1}$$

In the multi-channel signal separator 430, the M ABFs 431*a* and 431*b* adaptively filter signals output from the M subtractors 437*a* and 437*b* of the second subtractor 437 according to signals output from the M subtractors 433*a* and 433*b* of the first subtractor 433, so that a characteristic of speech components of the filtered signals output from the M ABFs 431*a* and 431*b* is the same as that of speech components of a microphone signal $x'_m(k)$, that is delayed for a predetermined period of time.

The M subtractors 433*a* and 433*b* of the first subtractor 433 respectively subtract the signals output from the M ABFs 431*a* and 431*b* from the speech signals $x_1'(k)$ and $x_M'(k)$, and respectively output signals $u_1(k)$ and $u_M(k)$ to the M ACFs 435*a* and 435*b*. When a coefficient vector of the $m^{th}$ ABF of the first filter 431 is $h^T_m(k)$ and the number of taps is L, the signal $u_m(k)$ output from the subtractors 433*a* and 433*b* of the first subtractor 433 can be represented as in Equation 2.

$$u_m(k)=x'_m(k)-h^T_m(k)w_m(k) \tag{2}$$

wherein, $h^T_m(k)$ and $w_m(k)$ can be represented as in Equations 3 and 4, respectively.

$$h_m(k)=[h_{m,1}(k), h_{m,2}(k), \ldots, h_{m,L}(k)]^T \tag{3}$$

wherein, $h_{m,l}(k)$ is an $l^{th}$ coefficient of $h_m(k)$.

$$W_m(k)=[w_m(k-1), w_m(k-2), \ldots, w_m(k-L)]^T \tag{4}$$

wherein, $w_m(k)$ denotes a vector collecting L past values of $w_m(k)$, L denotes the number of filter taps of the M ABFs 431*a* and 431*b*.

The M ACFs 435*a* and 435*b* of the second filter 435 adaptively filter the signals $u_1(k)$ and $u_M(k)$ output from the M subtractors 433*a* and 433*b* of the first subtractor 433 according to signals output from the M subtractors 437*a* and 437*b* of the second subtractor 437, so that a characteristic of noise components of the filtered signals output from the M ACFs 435*a* and 435*b* is the same as that of noise components of the signal b(k) output from the FBF 410.

The M subtractors 437*a* and 437*b* of the second subtractor 437 respectively subtract the signals output from the M ACFs 435*a* and 435*b* of the second filter 435 from the signal b(k) output from the FBF 410, and output $w_1(k)$ and $w_M(k)$ to the second adder 439. When a coefficient vector of the $m^{th}$ ACF of the second filter 435 is $g_m(k)$ and the number of taps is N, the signal $w_m(k)$ output from the M subtractors 437*a* and 437*b* of the second subtractor 437 can be represented as in Equation 5.

$$w_m(k)=b(k)-g^T_m(k)u_m(k) \tag{5}$$

wherein, $g^T_m(k)$ and $u_m(k)$ can be represented as in Equations 6 and 7, respectively.

$$g_m(k)=[g_{m,1}(k), g_{m,2}(k), \ldots, g_{m,N}(k)]^T \tag{6}$$

wherein, $g_{m,n}(k)$ denotes an $n^{th}$ coefficient of $g_m(k)$.

$$u_m(k)=[u_m(k-1), u_m(k-2), \ldots, u_m(k-N)]^T \tag{7}$$

wherein, $u_m(k)$ denotes a vector collecting N past values of $u_m(k)$ and N denotes the number of filter taps of the M ACFs 435*a* and 435*b*.

The second adder 439 adds $w_1(k)$ and $w_M(k)$ output from the M subtractors 437*a* and 437*b* of the second subtractor 437 and outputs a signal y(k) in which noise components are cancelled. The signal y(k) output from the second adder 439 can be represented as in Equation 8.

$$y(k) = \sum_{m=1}^{M} w_m(k),\ m = 1, \ldots M \tag{8}$$

Figure 5:
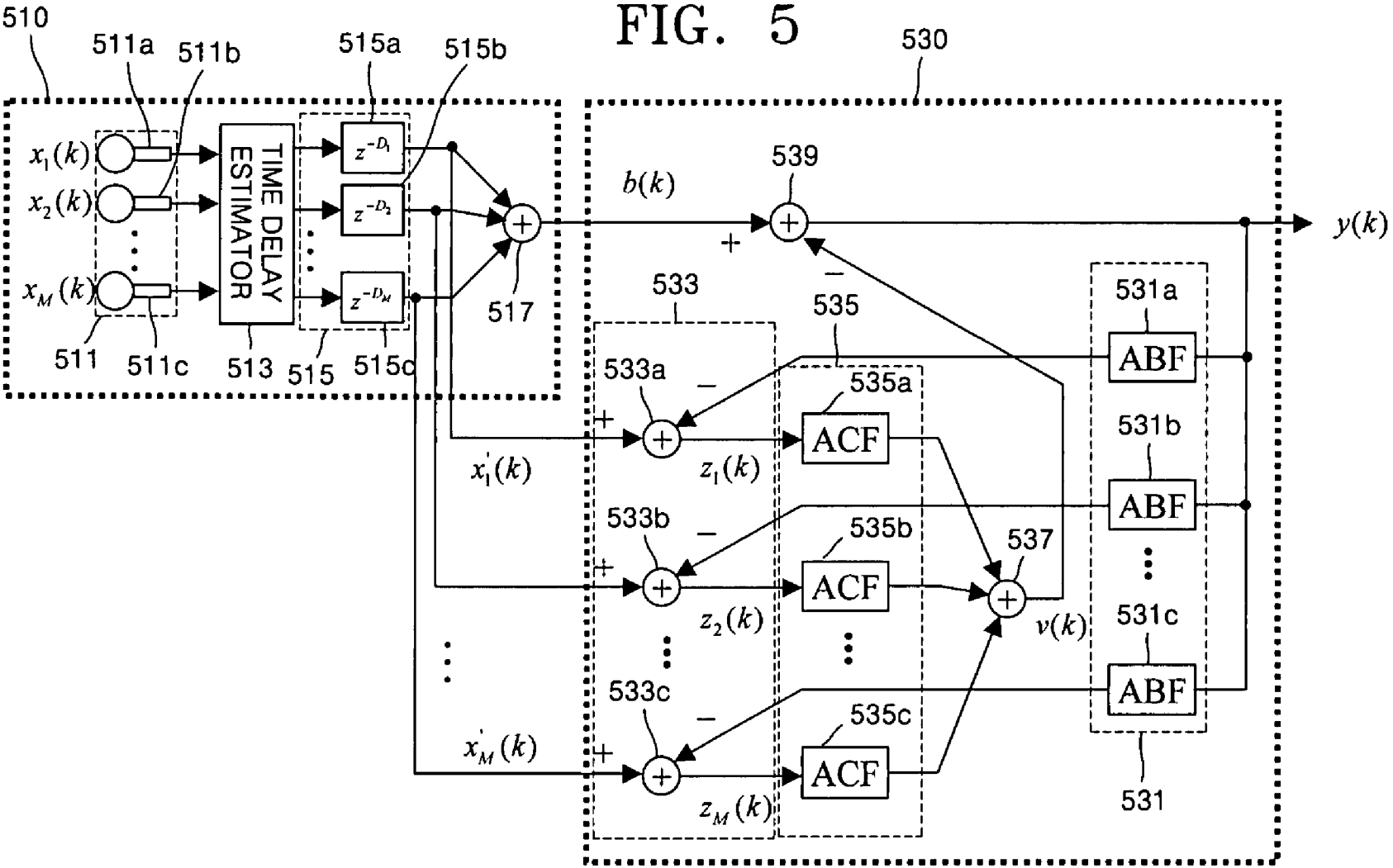
FIG. 5 is a block diagram of an adaptive beamformer according to another embodiment of the present invention.

FIG. 5 is a block diagram of an adaptive beamformer according to another embodiment of the present invention. Referring to FIG. 5, the adaptive beamformer includes a FBF 510 and a multi-channel signal separator 530. The FBF 510 includes a microphone array 511 having M microphones 511*a*, 511*b* and 511*c*, a time delay estimator 513, a delayer 515 having M delay devices 515*a*, 515*b* and 515*c*, and a first adder 517. The multi-channel signal separator 530 includes a first filter 531 having M ABFs 531*a*, 531*b*, and 531*c*, and a first subtractor 533 having M substractors 533*a*, 533*b* and 533*c*, a second filter 535 having M ACFs 535*a*, 535*b* and 535*c*, a second adder 537, and a second subtractor 539. Here, the structure and operation of the FBF 510 are the same as those of the FBF 410 shown in FIG. 4, and thus will not be described herein; only the multi-channel separator 530 will be described.

Referring to FIG. 5, in the multi-channel signal separator 530, the M ABFs 531*a*, 531*b* and 531*c* of the first filter 531 adaptively filter a signal y(k) output from the second subtractor 539 according to signals output from the M subtractors 533*a*, 533*b* and 533*c* of the first subtractor 533, so that a characteristic of speech components of the filtered signals output from the M ABFs 531*a*, 531*b* and 531*c* is the same as that of speech components of a microphone signal $x'_m(k)$, that is delayed for a predetermined period of time.

The M subtractors 533*a*, 533*b* and 533*c* of the first subtractor 533 respectively subtract the signals output from ABFs 531*a*, 531*b* and 531*c* from microphone signals $x_1'(k)$, $x_2'(k)$ and $x_M'(k)$ delayed for a predetermined period of time and output signals $z_1(k)$, $z_2(k)$ and $z_M(k)$ to the M ACFs 535*a*, 535*b* and 535*c* of the second filter 535. When a coefficient vector of the $m^{th}$ ABF of the first filter 531 is $h_m(k)$ and the number of taps is L, the signal $z_m(k)$ output from the M subtractors 533*a*, 533*b* and 533*c* of the first subtractor 533 can be represented as in Equation 9.

$$z_m(k)=x'_m(k)-h^T_m(k)y(k),\ m=1,\ldots,M \tag{9}$$

wherein, $h^T_m(k)$ and y(k) can be represented as in Equations 10 and 11, respectively.

$$h_m(k)=[h_{m,1}(k),\ h_{m,2}(k),\ \ldots,\ h_{m,L}(k)]^T \tag{10}$$

wherein, $h_{m,l}(k)$ denotes an $l^{th}$ coefficient of $h_m(k)$.

$$y(k)=[y(k-1),\ y(k-2),\ \ldots,\ y(k-L)]^T \tag{11}$$

wherein, y(k) denotes a vector collecting L past values of y(k) and L denotes the number of filter taps of the M ABFs 531*a*, 531*b* and 531*c*.

The M ACFs 535*a*, 535*b* and 535*c* of the second filter 535 adaptively filter the signals $z_1(k)$, $z_2(k)$ and $z_M(k)$ output from the M subtractors 533*a*, 533*b* and 533*c* of the first subtractor 533 according to a signal output from the second subtractor 539, so that a characteristic of noise components of a signal v(k) output from the second adder 537 is the same as that of noise components of the signal b(k) output from the FBF 510.

The second adder 537 adds the signals output from the M ACFs 535*a*, 535*b* and 535*c*. When a coefficient of the $m^{th}$ ACF of the second filter 535 is $g_m(k)$ and the number of taps is N a signal v(k) output from the second adder 537 can be represented as in Equation 12.

$$v(k)=\sum_{m=1}^{M} g^T_m(k)z_m(k),\ m=1,\ \ldots,\ M \tag{12}$$

wherein, $g^T_m(k)$ and $z_m(k)$ can be represented as in Equations 13 and 14, respectively.

$$g_m(k)=[g_{m,1}(k),\ g_{m,2}(k),\ \ldots,\ g_{m,N}(k)]^T \tag{13}$$

wherein, $g_{m,n}(k)$ denotes an $n^{th}$ coefficient of $g_m(k)$.

$$z_m(k)=[z_m(k-1),\ z_m(k-2),\ \ldots,\ z_m(k-N)]^T \tag{14}$$

wherein, $z_m(k)$ denotes a vector collecting N past values of $z_m(k)$ and N denotes the number of filter taps of the M ACFs 535*a*, 535*b* and 535*c*.

The second subtractor 539 subtracts the signal v(k) output from the second adder 537 from the signal b(k) output from the FBF 510 and outputs the signal y(k). The signal y(k) output from the second subtractor 539 can be represented as in Equation 15.

$$y(k)=b(k)-v(k) \tag{15}$$

In the above-described embodiments, the M ABFs 431*a* and 431*b* of the first filter 431, the M ABFs 531*a*, 531*b* and 531*c* of the first filter 531, M ACFs 435*a* and 435*b* of the second filter 435, and the M ACFs 535*a*, 535*b* and 535*c* of the second filter 535 illustrated in FIGS. 4 and 5 respectively, may be FIR filters. In view of inputs and outputs, each of the filters is an FIR filter. However, the multi-channel signal separators 430 and 530 may be regarded as infinite impulse response (IIR) filters in view of inputs, i.e., the signal b(k) output from the FBFs 410 and 510 and the microphone signals $x_1'(k)$, $x_2'(k)$ and $x_M'(k)$ delayed for a predetermined period of time, and outputs, i.e., the signal y(k) output from the second adder 439 shown in FIG. 4 and the second subtractor 539 shown in FIG. 5. This is because the M ABFs 431*a* and 431*b* and the M ABFs 531*a*, 531*b* and 531*c* of the first filters 431 and 531 and the M ACFs 435*a* and 435*b* and the M ACFs 535*a*, 535*b* and 535*c* of the second filters 435 and 535 have a feedback connection structure.

Coefficients of the FIR filters are updated by the information maximization algorithm proposed by Anthony J. Bell. The information maximization algorithm is a statistical learning rule well known in the field of independent component analysis, by which non-Gaussian data structures of latent sources are found from sensor array observations on the assumption that the latent sources are statistically independent. Because the information maximization algorithm does not need a voice activity detector (VAD), coefficients of ABFs and ACFs can be automatically adapted without knowledge of the desired and undesired signal levels.

According to the information maximization algorithm, coefficients of the M ABFs 431*a* and 431*b* and the M ACFs 435*a* and 435*b* are updated as in Equations 16 and 17.

$$h_{m,l}(k+1)=h_{m,l}(k)+\alpha SGN(u_m(k))w_m(k-l) \tag{16}$$

$$g_{m,n}(k+1)=g_{m,n}(k)+\beta SGN(w_m(k))u_m(k-n) \tag{17}$$

wherein, α and β denote step sizes for learning rules and SGN(·) is a sign function which is +1 if an input is greater than zero and −1 if the input is less than zero.

According to the information maximization algorithm, coefficients of the M ABFs 531*a*, 531*b* and 531*c* and the M ACFs 535*a*, 535*b* and 535*c* are updated as in Equations 18 and 19.

$$h_{m,l}(k+1)=h_{m,l}(k)+\alpha SGN(z_m(k))y(k-l) \tag{18}$$

$$g_{m,n}(k+1)=g_{m,n}(k)+\beta SGN(y(k))z_m(k-n) \tag{19}$$

wherein, α and β denote step sizes for learning rules and SGN(·) is a sign function which is +1 if an input is greater than zero and −1 if the input is less than zero. The sign function SGN(·) could be replaced by any kind of saturation function, such as a sigmoid function and a tanh(·) function.

In addition, coefficients of the M ABFs 431*a* and 431*b*, the M ABFs 531*a*, 531*b* and 531*c*, M ACFs 435*a* and 435*b*, and the M ACFs 535*a*, 535*b* and 535*c* can be updated using any kind of statistical learning algorithms such as a least square algorithm and its variant, a normalized least square algorithm.

As described above, when the M ABFs 431*a* and 431*b* and the M ACFs 435*a* and 435*b*, and the M ABFs 531*a*, 531*b* and 531*c* and the M ACFs 535*a*, 535*b* and 535*c* are FIR filters and connected in a feedback structure, and the number of microphones of each of the microphone arrays 411 and 511 is 8, the number of filter taps of the adaptive beamformer shown in FIG. 4 or 5 is 8×(128+128)=2048, which is much fewer than the number 8×(512+128)=5120 of filter taps of the conventional adaptive beamformer shown in FIG. 1.

Figure 6:
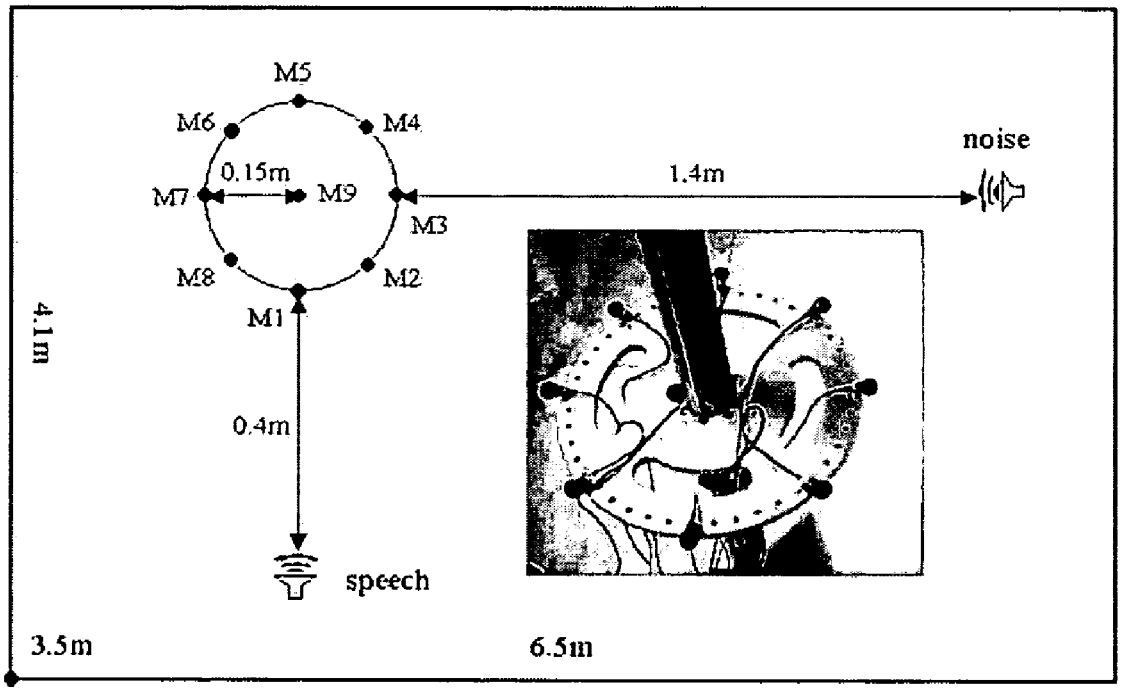
FIG. 6 illustrates an experimental environment used to compare an adaptive beamformer according to the present invention and the conventional adaptive beamformer shown in FIG. 1.

FIG. 6 illustrates an experimental environment used for comparing an adaptive beamformer according to the present invention and the conventional adaptive beamformer shown in FIG. 1. A circular microphone array having a diameter of 30 cm was located in the center of a room having a length of 6.5 m, a width of 4.1 m, and a height of 3.5 m. Eight microphones were installed on the circular microphone array equidistant from adjacent microphones. The heights of the microphone array, a target speaker, and a noise speaker were all 0.79 m from the floor. Target sources were speech waves of 40 words pronounced by four male speakers, and noise sources were a fan and music.

The results of an objective evaluation of the performance of the two adaptive beamformers in the above-described experimental environment, e.g., a comparison of SNRs, are shown in Table 1 (all units are in dBs).

TABLE 1

| | Raw Signal | Prior Art (GSC) | Present Invention |
|---|---|---|---|
| FAN | 9.0 | 19.5 | 27.5 |
| MUSIC | 6.9 | 15.5 | 24.9 |
| $\Delta_{FAN}$ | X | 10.5 | 18.5 |
| $\Delta_{MUSIC}$ | X | 8.6 | 18.0 |

As can be seen in Table 1, the SNR in a beamforming method according to the present invention is roughly double the SNR in a beamforming method according to the prior art.

For a subjective evaluation in the experimental environment, e.g., an AB preference test, after ten people had listened to outputs of a beamformer according to the prior art and a beamformer according to the present invention, they were asked to choose one of the following sentences for evaluation, which are "A is much better than B", "A is better than B", "A and B are the same", "A is worse than B", and "A is much worse than B". A test program randomly determined which one of the beamformers according to the prior art and the present invention would output signal A. Also, two points were given for "much better", one point for "better", and no points for "the same" and then the results were summed. The subjective evaluation compared 40 words for fan noise and another 40 words for music noise, and the results of the comparison are shown in Table 2.

TABLE 2

| | Prior art (GSC) | Present Invention |
|---|---|---|
| FAN | 78 | 517 |
| MUSIC | 140 | 284 |

As can be seen in Table 2, the outputs of the beamformer according to the present invention are superior to the outputs of the beamformer according the prior art.

As described above, according to the present invention, by connecting ABFs and ACFs in a feedback structure, noise components contained in a wideband speech signal input via a microphone array comprising at least two microphones can be nearly completely cancelled. Also, while the ABFs and the ACFs have been realized as FIR filters and connected in a feedback structure, the ABFs and the ACFs may be regarded as IIR filters, which reduces the number of filter taps. In addition, since an information maximization algorithm can be used to learn coefficients of the ABFs and the ACFs, the number of parameters necessary for learning can be reduced and a VAD for detecting whether speech signals exist is not necessary.

Moreover, a method and apparatus adaptively beamforming according to the present invention are not greatly affected by the size, arrangement, or structure of a microphone array. Also, a method and apparatus adaptively beamforming according to the present invention are more robust against look directional errors than the conventional art, regardless of the type of noise.

The present invention can be realized as a computer-readable code on a computer-readable recording medium. Such a computer-readable medium may be any kind of recording medium in which computer-readable data is stored. Examples of such computer-readable media include ROMs, RAMs, CD-ROMs, magnetic tapes, floppy discs, optical data storing devices, and carrier waves (e.g., transmission via the Internet), and so forth. Also, the computer-readable code can be stored on the computer-readable media distributed in computers connected via a network. Furthermore, functional programs, codes, and code segments for realizing the present invention can be easily analogized by programmers skilled in the art.

Moreover, a method and apparatus adaptively beamforming according to the present invention can be applied to autonomous mobile robots to which microphone arrays are attached, and to vocal communication with electronic devices in an environment where a user is distant from a microphone. Examples of such electronic devices include personal digital assistants (PDA), WebPads, and portable phone terminals in automobiles, having a small number of microphones. With the present invention, the performance of a voice recognizer can be considerably improved.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An adaptive beamforming method, comprising:

compensating for time delays of M noise-containing speech signals input via a microphone array having M microphones, wherein M is an integer greater than or equal to 2, and generating a sum signal of the M compensated noise-containing speech signals; and extracting pure noise components from the M compensated noise-containing speech signals using feedback providing a noise-removed signal to M adaptive blocking filters and M adaptive canceling filters connected in a feedback structure and finally generating the noise-removed signal from the sum signal by providing the pure components to the M adaptive canceling filters.

2. The method of claim 1, wherein the extracting of the pure noise components comprises:

filtering a noise-removed sum signal through the M adaptive blocking filters;

subtracting signals output from the M adaptive blocking filters from the M compensated noise-containing speech signals to output M noise signals;

filtering the M noise signals through the M adaptive canceling filters;

subtracting signals output from the M adaptive canceling filters from the sum signal and inputting M subtraction results to the M adaptive blocking filters as the noise-removed sum signal; and adding the M subtraction results.

3. The method of claim 1, wherein the extracting of the pure noise components comprises:

filtering a noise-removed sum signal through the M adaptive blocking filters;

subtracting signals output from the M adaptive blocking filters from the M compensated noise-containing speech signals to output M noise signals;

filtering the M noise signals through the M adaptive canceling filters;

adding signals output from the M adaptive canceling filters and outputting an adaptive canceling filter sum signal; and subtracting the adaptive canceling filter sum signal from the sum signal and inputting M subtraction results to the M adaptive blocking filters as the noise-removed sum signal.

4. The method of claim 2, wherein the M adaptive blocking filters and the M adaptive canceling filters are finite impulse response filters.

5. The method of claim 4, wherein coefficients of the M adaptive blocking filters and the M adaptive canceling filters are updated by an information maximization algorithm.

6. The method of claim 3, wherein the M adaptive blocking filters and the M adaptive canceling filters are finite impulse response filters.

7. The method of claim 6, wherein coefficients of the M adaptive blocking filters and the M adaptive canceling filters are updated by an information maximization algorithm.

8. An adaptive beamforming apparatus, comprising:

a fixed beamformer that compensates for time delays of M noise-containing speech signals input via a microphone array having M microphones, wherein M is an integer greater than or equal to 2, and generates a sum signal of the M compensated noise-containing speech signals; and a multi-channel signal separator that extracts pure noise components from the M compensated noise-containing speech signals using feedback providing a noise-removed signal to M adaptive blocking filters and M adaptive canceling filters connected in a feedback structure and finally generates the noise-removed signal from the sum signal by providing the pure noise components to the M adaptive canceling filters.

9. The apparatus of claim 8, wherein the fixed beamformer comprises:

a time delay estimator that calculates time delays of the M noise-containing speech signals input via the microphone array;

a delay unit that delays the M noise-containing speech signals by the time delays calculated by the time delay estimator; and a first adder that adds the M noise-containing speech signals delayed by the delay.

10. The apparatus of claim 8, wherein the multi-channel signal separator comprises:

a first filter that filters a noise-removed sum signal through the M adaptive blocking filters;

a first subtractor that subtracts signals output from the M adaptive blocking filters from the M compensated noise-containing speech signals using M subtractors;

a second filter that filters M subtraction results of the first subtractor through the M adaptive canceling filters;

a second subtractor that subtracts signals output from the M adaptive canceling filters from the sum signal using M subtractors, and inputs M subtraction results to the M adaptive blocking filters as the noise-removed sum signal; and a second adder that adds signals output from the M subtractors of the second subtractor.

11. The apparatus of claim 8, wherein the multi-channel signal separator comprises:

a first filter that filters a noise-removed sum signal through the M adaptive blocking filters;

a first subtractor that subtracts signals output from the M adaptive blocking filters from the M compensated noise-containing speech signals using M subtractors;

a second filter that filters signals output from the M subtractors of the first subtractor through the M adaptive canceling filters;

a second adder that adds signals output from M adaptive canceling filters of the second filter; and a second subtractor that subtracts signals output from the second adder from the signals output from the fixed beamformer and inputs M subtraction results to the M adaptive blocking filters as the noise-removed sum signal.

12. The apparatus of claim 10, wherein the M adaptive blocking filters and the M adaptive canceling filters are finite impulse response filters.

13. The apparatus of claim 12, wherein coefficients of the M adaptive blocking filters and the M adaptive canceling filters are updated by an information maximization algorithm.

14. The apparatus of claim 11, wherein the M adaptive blocking filters and the M adaptive canceling filters are finite impulse response filters.

15. The apparatus of claim 14, wherein coefficients of the M adaptive blocking filters and the M adaptive canceling filters are updated by an information maximization algorithm.

16. An adaptive beamforming apparatus, comprising:

a receiver that receives signals including noise components, delays the received signals by a calculated time to provide delayed received signals, and adds the delayed received signals to provide a combination received signal;

a signal separator that generates a clean signal without noise components based on adaptively filtering the delayed received signals and the combination received signal by a plurality of adaptive blocking filters having blocking coefficients and a plurality of adaptive canceling filters having canceling coefficients connected in a feedback structure, wherein the blocking coefficients and the canceling coefficients are automatically updated during operation of the signal separator.

17. The apparatus of claim 16, wherein the feedback structure of the signal separator comprises:

a plurality of first subtractors that receive the delayed received signals and subtract corresponding signals from the plurality of adaptive blocking filters to output separate noise component signals; and a plurality of second subtractors that receive the combination received signal and subtract corresponding signals from the plurality of adaptive canceling filters to output separate clean signals without noise components, wherein the plurality of adaptive blocking filters receive the corresponding separate clean signals without noise components as inputs, and the plurality of adaptive canceling filters receive the corresponding separate noise component signals as inputs.

18. The apparatus of claim 17, wherein the adaptive blocking filters and the adaptive canceling filters are finite impulse response filters.

19. The apparatus of claim 18, wherein the blocking coefficients and the canceling coefficients are updated automatically by an information maximization algorithm.

20. The apparatus of claim 19, wherein a number of taps necessary to implement the feedback structure is optimized.

21. The apparatus of claim 16, wherein the feedback structure of the signal separator comprises:

a plurality of first subtractors that receive the delayed received signals and subtract corresponding signals from the plurality of adaptive blocking filters, and the plurality of first subtractors outputs signals to the plurality of adaptive canceling filters;

an adder that adds signals output from the plurality of adaptive canceling filters to output a total noise component signal; and a second subtractor that receives the combination received signal and subtracts the total noise component signal to output a clean signal without noise components, wherein the plurality of adaptive blocking filters receive the clean signal without noise components as an input and the adaptive blocking filters generate signals corresponding to a portion of the clean signal without noise components of the delayed received signals to the plurality of first subtractors.

22. The apparatus of claim 21, wherein the adaptive blocking filters and the adaptive canceling filters are finite impulse response filters.

23. The apparatus of claim 22, wherein the blocking coefficients and the canceling coefficients are updated automatically by an information maximization algorithm.

24. The apparatus of claim 23, wherein a number of taps necessary to implement the feedback structure is optimized.

25. A method of removing noise from time delayed signals subject to noise, comprising:

receiving signals having noise components;

delaying the received signals having the noise components by a predetermined period of time to generate delayed received signals;

adding the delayed received signals to generate a combination received signal;

generating separate clean signals without noise components using adaptive feedback filtering based on the delayed received signals, the combination received signal, and the separate clean signals, the adaptive feedback filtering being performed with adaptive blocking filters and adaptive canceling filters connected in a feedback structure; and generating a clean signal without noise components using the separate clean signals.

26. The method of claim 25, wherein using adaptive feedback filtering comprises:

generating separate clean signals without noise components by subtracting noise components, output from adaptive canceling filters having predetermined coefficients, from the combination received signal;

generating separate noise signals by subtracting signals output from adaptive blocking filters having predetermined coefficients, which receive the separate clean signals, from the delayed received signals, wherein the adaptive blocking filters having the predetermined coefficients and the adaptive canceling filters having the predetermined coefficients are respectively connected in a feedback structure.

27. The method of claim 26, wherein generating the clean signal without noise components comprises adding the separate clean signals.

28. The method of claim 26, further comprising:

updating the coefficients of the adaptive canceling filters and the adaptive blocking filters without signal level information.

29. The method of claim 26, further comprising:

updating the coefficients of the adaptive canceling filters and the adaptive blocking filters automatically by an information maximization algorithm.

30. The method of claim 26, further comprising:

updating the coefficients of the adaptive canceling filters and the adaptive blocking filters automatically by one of a least square algorithm and a normalized least square algorithm.

* * * * *

UNITED STATES PATENT AND TRADEMARK OFFICE

CERTIFICATE OF CORRECTION

PATENT NO. : 7,443,989 B2
APPLICATION NO. : 10/757994
DATED : October 28, 2008
INVENTOR(S) : Chang-kyu Choi et al.

It is certified that error appears in the above-identified patent and that said Letters Patent is hereby corrected as shown below:

First Page, Column 2 (Other Publications), Line 8, before “Noise” change “Adptive” to --Adaptive--.

Column 10, Line 60, after “pure” insert --noise--.

Column 10, Line 63, after “filtering” change “a” to --the--.

Column 11, Line 10, after “filtering” change “a” to --the--.

Column 11, Line 63, after “filters” change “a” to --the--.

Column 12, Line 12, after “filters” change “a” to --the--.

Signed and Sealed this

Tenth Day of February, 2009

John Doll

JOHN DOLL
*Acting Director of the United States Patent and Trademark Office*